US005655486A

United States Patent [19]

Mayne

[11] Patent Number: 5,655,486

[45] Date of Patent: Aug. 12, 1997

[54] ENGINE COMBUSTION

[75] Inventor: Alfred Rickard Mayne, Arundel, Australia

[73] Assignee: Split Cycle Technology Limited, Australia

[21] Appl. No.: 696,239

[22] Filed: Aug. 13, 1996

Related U.S. Application Data

[60] Provisional application No. 60/002,937, Aug. 30, 1995.

[51] Int. Cl.[6] ..... F02B 75/22

[52] U.S. Cl. ..... 123/542; 123/197.1; 92/148

[58] Field of Search ..... 123/54.2, 54.3, 123/197.1; 92/140, 148; 74/129; 475/14

[56] References Cited

U.S. PATENT DOCUMENTS

| | | | |
|---|---|---|---|
| 2,404,752 | 7/1946 | Schoenfeld et al. | 123/54.2 |
| 3,948,230 | 4/1976 | Burns | 123/54.3 |
| 5,146,880 | 9/1992 | Mayne | 123/197.1 |
| 5,279,209 | 1/1994 | Mayne | 123/197.1 |
| 5,315,967 | 5/1994 | Schoell | 123/54.3 |

OTHER PUBLICATIONS

Puch 250 SGS Motor Bike, Motor Cycling Magazine, Oct. 1, 1979. Oct. 1, 1979.

The Blueprint (Engine & Connecting Rod) and drafting drawings. Jan. 1, 1979.

*Primary Examiner*—David A. Okonsky
*Attorney, Agent, or Firm*—Baker & Botts, L.L.P.

[57] ABSTRACT

A machine having a piston unit within a cylinder arrangement wherein each piston unit comprises a plurality of in-line pistons within their respective cylinders such that the pistons are in fluid communication with a common compression chamber and where the pistons of each unit move in unison.

5 Claims, 3 Drawing Sheets

ENGINE COMBUSTION

RELATED APPLICATIONS

This application claims the benefit of United States Provisional Application No. 60/002,937, filed Aug. 30, 1995.

TECHNICAL AREA

The present invention relates to internal combustion engines, pumps or compressors and more particularly to multiple piston arrangements having a common combustion chamber.

BACKGROUND OF INVENTION

In a general sense, multiple pistons operating in a common combustion chamber are known in conventionally cranked internal combustion engines from such as a split single cylinder twin piston engine in which two parallel cylinders are siamesed by a common combustion chamber having their pistons linked to a common crank pin. Such existing arrangements employ a differential motion between the pistons because of the common crank which can lead to improved engine scavenging.

In the present invention a plurality of pistons are employed in compressing the charge of a single combustion chamber with particular applicability to radial cylinder machines or rotary machines as disclosed in our International patent applications PCT/AU89/00275 and PCT/AU91/00224 hereinafter referred to as split-cycle machines. The multiple piston single combustion chamber arrangement of the present invention is equally applicable to compressors or pumps as it is to engines.

SUMMARY OF THE INVENTION

In one aspect the present invention provides a rotary machine of the form disclosed in our aforementioned International patent applications wherein each piston-cylinder arrangement comprises a plurality of grouped pistons in respective cylinders, the pistons being disposed in-line in a plane containing the axis of the machine, each group of pistons being coupled to a common piston follower adapted to control the rise and fall of said pistons under the action of lobes on lobed shafts contacting said common follower, a common elongate fluid compression chamber being mounted atop each group of pistons and cylinders.

By means of arrangements in accord with the present invention, the overall radial dimension of the machine can be restricted while maintaining the same volumetric fluid flow as compared with machines having a single larger diameter similarly stroked piston instead of groups of multiple in-line pistons with a common fluid compression chamber.

In the case of an arrangement of the present invention employed in an internal combustion engine there is provided extended cross-flow combustion chamber from which we have found there to be the ability to provide substantially complete combustion of the fuel charge and with exhaust gases exiting the combustion chamber at relatively low temperatures compared with conventional combustion arrangements.

Preferably the multiple pistons of each group rise and fall in unison.

BRIEF DESCRIPTION OF THE DRAWINGS

An embodiment of the present invention will now be described by way of example with reference to the accompanying drawings, in which.

DESCRIPTION OF THE PREFERRED EMBODIMENT

Figure 1:
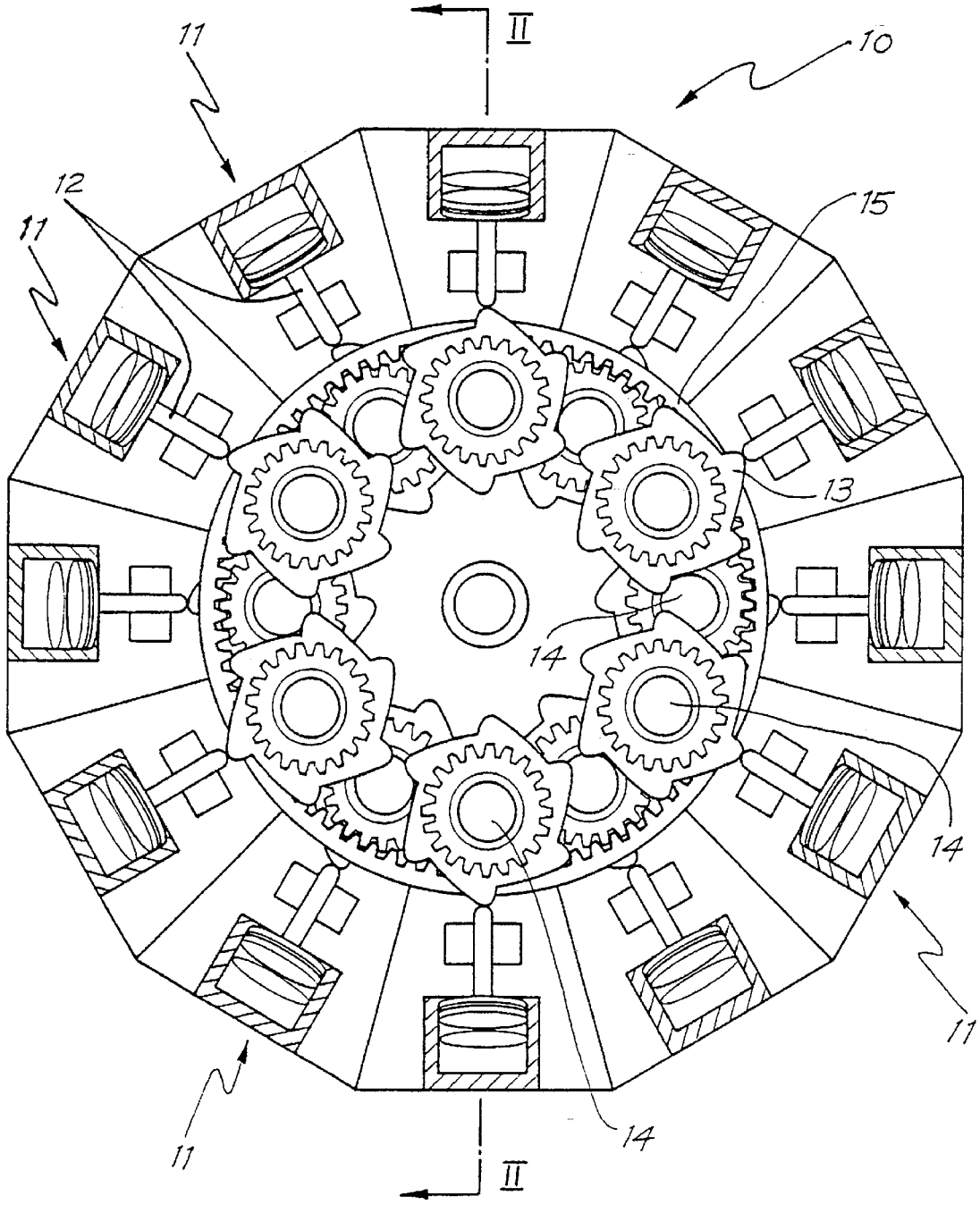
FIG. 1 is a schematic transverse cross-sectional view of a rotary machine employing groups of multiple pistons aligned axially of the machine.
Figure 2:
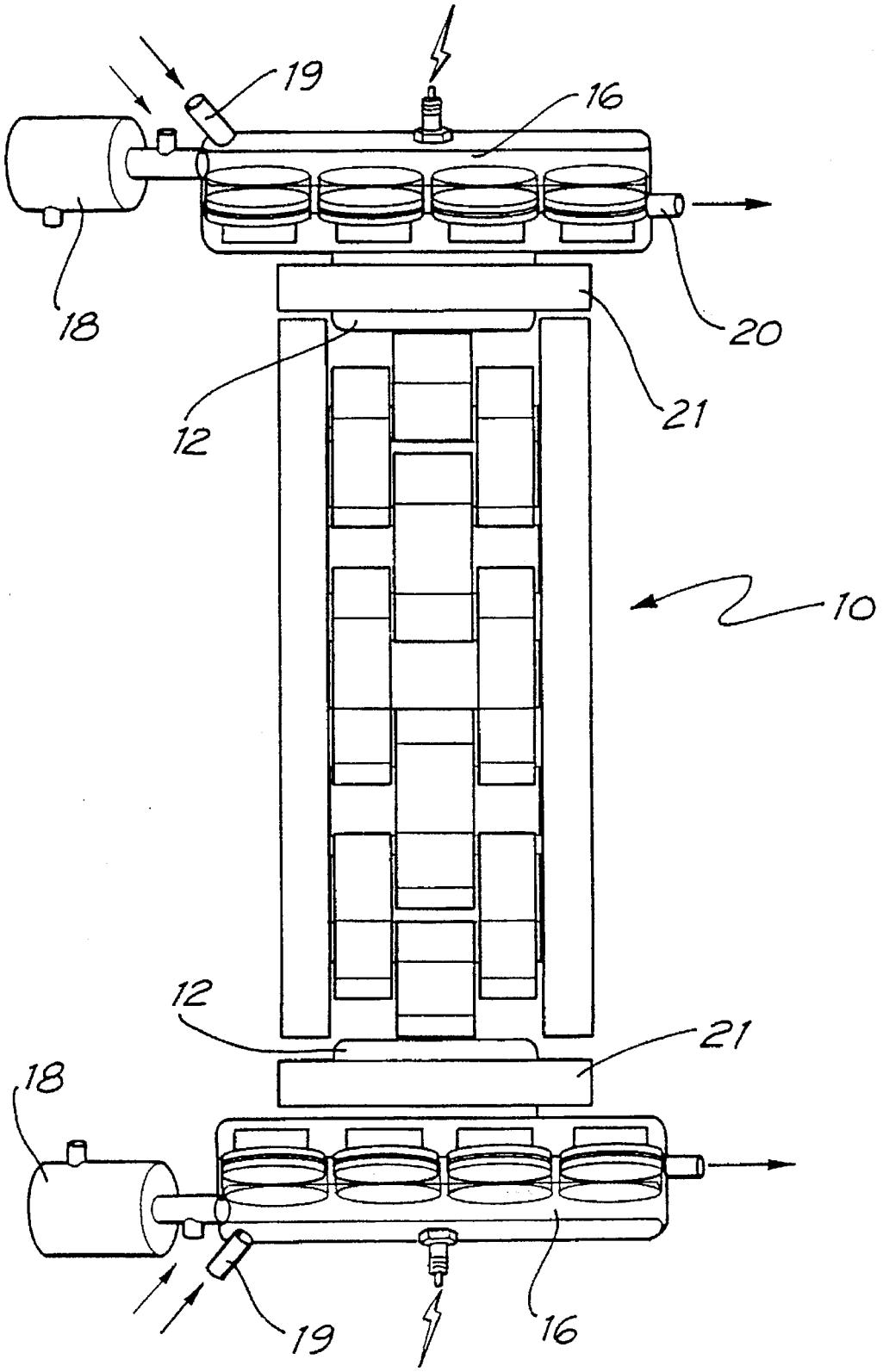
FIG. 2 is a schematic axial cross-sectional view 2—2 of FIG. 1.

In the embodiment of FIGS. 1 and 2 the rotary machine 10 comprises twelve radially disposed piston sets 11 having followers 12 controlled to move in accord with the shape of the lobes 13 on lobed shafts 14 which rotate around planet gear 15.

As shown in axial cross-section in FIG. 2 a single combustion chamber 16 is mounted above each of the grouped piston sets 11. In this example each piston set comprises four pistons while on spark plug 17 is shown mounted in each combustion chamber 16. In an alternate form each combustion chamber is fitted with a pair of spark plugs 17.

Fuel and air is fed to combustion chamber 16 via fuel injector 18 and air inlet passage 19 which feeds in air under pressure. The injector 18 is preferably in the form of a pulsed injector as shown in U.S. Ser. No. 08/411824. The elongate nature of the combustion chamber 16 combined with the fuel and air inlet at one end and the exhaust outlet 20 at an opposite end provides an effective cross flow cylinder head arrangement which promotes improved combustion and cleaner burning of each fuel charge as well as eliminating any tortuous pathway for the charge to exit the combustion chamber after combustion.

Figure 3:
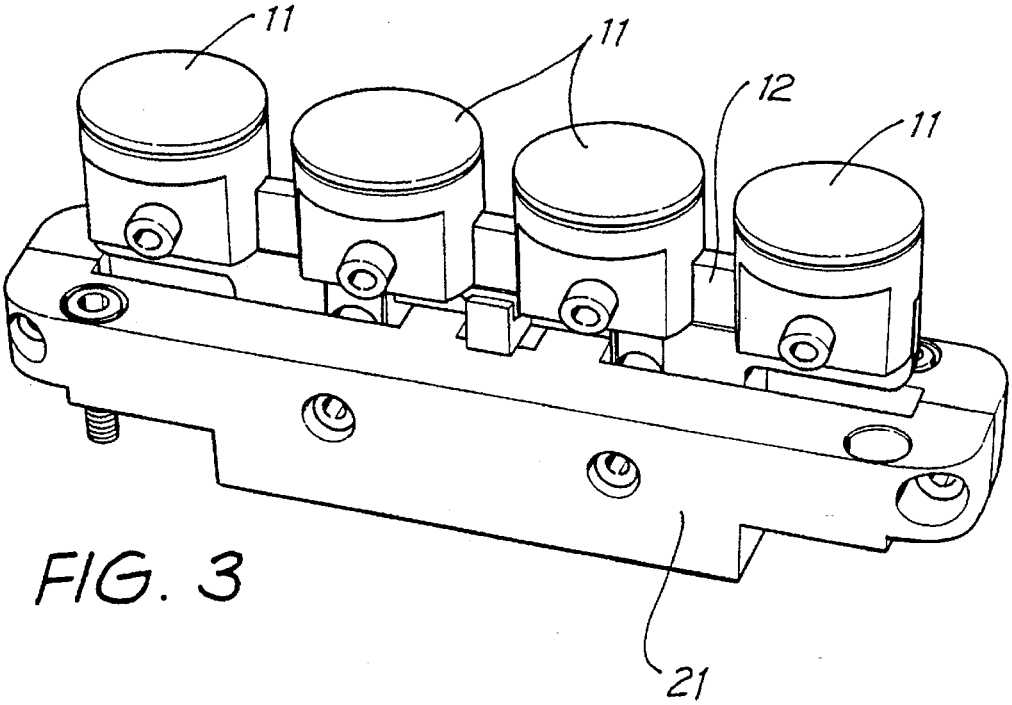
FIG. 3 is a perspective view of a grouped piston arrangement on a common follower mounted to a common holder to be bolted to a radial cylinder machine of the type of FIGS. 1 and 2.

A four piston arrangement embodiment is shown in FIG. 3 wherein each piston 11 is securely mounted to a common follower 12. The follower 12 is spring biased within supporting bridge 21 towards the bottom dead centre position for the pistons. Such biasing functions to maintain the follower 12 in contact with the lobes 13 on the lobed shafts 14 during the expansion stroke even when there is no charge combusted in the associated cylinder.

Figure 4:
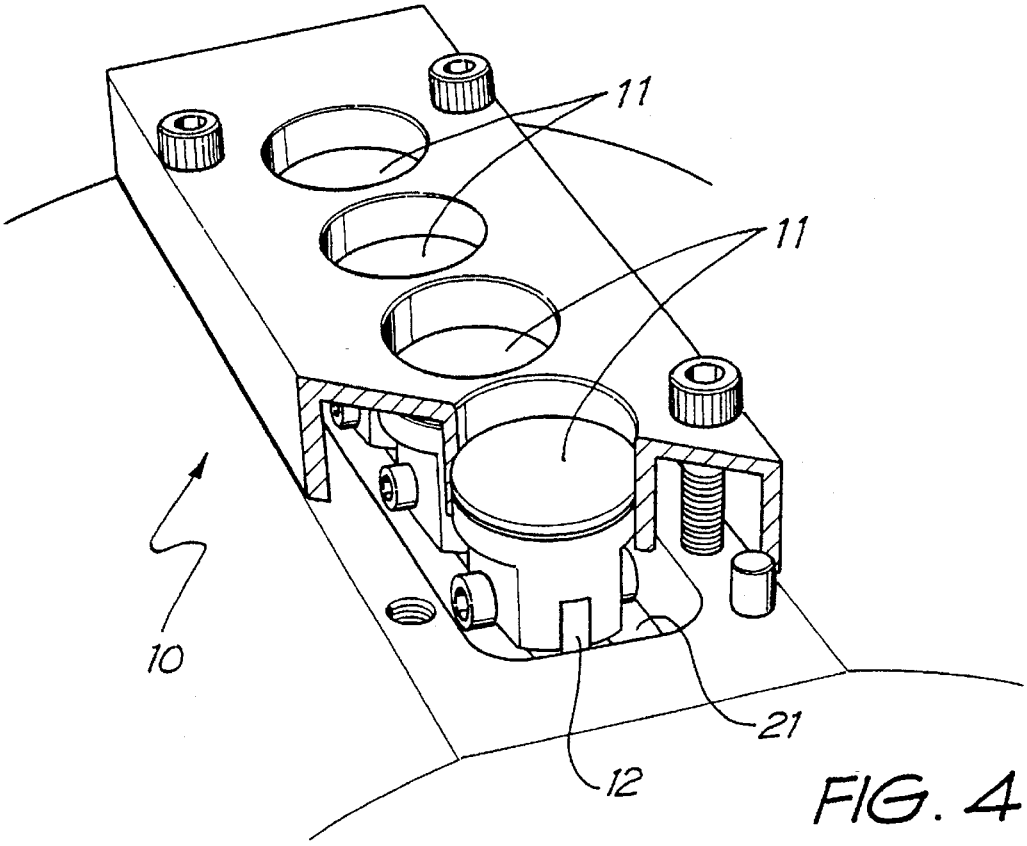
FIG. 4 is a perspective partially cut-away view of one bank of a group of pistons mounted to a machine with an associated common cylinder head removed.

FIG. 4 shows an arrangement in accord with FIG. 3 mounted into a split cycle machine with a partial cutaway view of the associated cylinder bores in place but without the common cylinder head placed atop the bores.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A rotary machine comprising at least one piston in cylinder arrangement for effecting rotary motion wherein each piston-cylinder arrangement comprises a plurality of grouped pistons in respective cylinders, the pistons being disposed in-line in a plane containing the axis of the machine, each group of pistons being coupled to a common piston follower adapted to control the rise and fall of said pistons under the action of lobes on lobed shafts contacting said common follower, a common elongate fluid compression chamber being mounted atop each group of pistons and cylinders.

2. A rotary machine as claimed in claim 1 wherein the grouped pistons of each arrangement rise and fall in unison in their respective cylinders.

3. A rotary machine as claimed in claim 1 or 2 wherein said machine is used as internal combustion engine such that said common fluid compression chamber is a combustion chamber.

4. A rotary machine as claimed in claim 1 or 2 wherein said machine is used as a pump.

5. A rotary machine as claimed in claim 1 or 2 wherein said machine is used as a compressor.

* * * * *